US005647725A

United States Patent [19]

Kraus et al.

[11] Patent Number: 5,647,725

[45] Date of Patent: Jul. 15, 1997

[54] METHOD FOR PREPARING A SHEET STACK FOR PROCESSING IN A SHEET-PROCESSING MACHINE

[75] Inventors: Hans-Peter Kraus, Donzdorf; Martin Benz, Treffelhausen, both of Germany

[73] Assignee: MAN Roland Druckmaschinen AG, Germany

[21] Appl. No.: 446,472

[22] Filed: May 22, 1995

[51] Int. Cl.[6] ..... B65G 1/18

[52] U.S. Cl. ..... 414/799; 414/783; 414/927; 414/928; 414/929

[58] Field of Search ..... 414/404, 416, 414/403, 795.2, 795.3, 799, 778, 783, 927, 928, 929

[56] References Cited

U.S. PATENT DOCUMENTS

| | | | |
|---|---|---|---|
| 3,269,565 | 8/1966 | Kemp, Jr. | 414/417 |
| 3,499,560 | 3/1970 | Gros | 414/404 |
| 3,946,880 | 3/1976 | Scmitt | 414/783 |
| 4,178,119 | 12/1979 | Busch | 414/783 |
| 4,338,055 | 7/1982 | Petersson | 414/778 |
| 5,102,282 | 4/1992 | Maddox | 414/429 |
| 5,118,243 | 6/1992 | Huebner et al. | 414/404 |

FOREIGN PATENT DOCUMENTS 6806842 7/1969 Germany .

*Primary Examiner*—Karen B. Merritt
*Assistant Examiner*—Douglas Hess
*Attorney, Agent, or Firm*—Leydig, Voit & Mayer, Ltd.

[57] ABSTRACT

A method and apparatus for preparing a sheet stack for automated processing, wherein a sheet stack and transportation pallet are deposited on a system pallet, the resulting stack is manipulated to a release position where the transportation pallet is freed, the freed transportation pallet is removed, and the sheet stack and system pallet are conveyed away for further processing. The apparatus includes structure for carrying out these steps.

11 Claims, 3 Drawing Sheets

FIG. 2
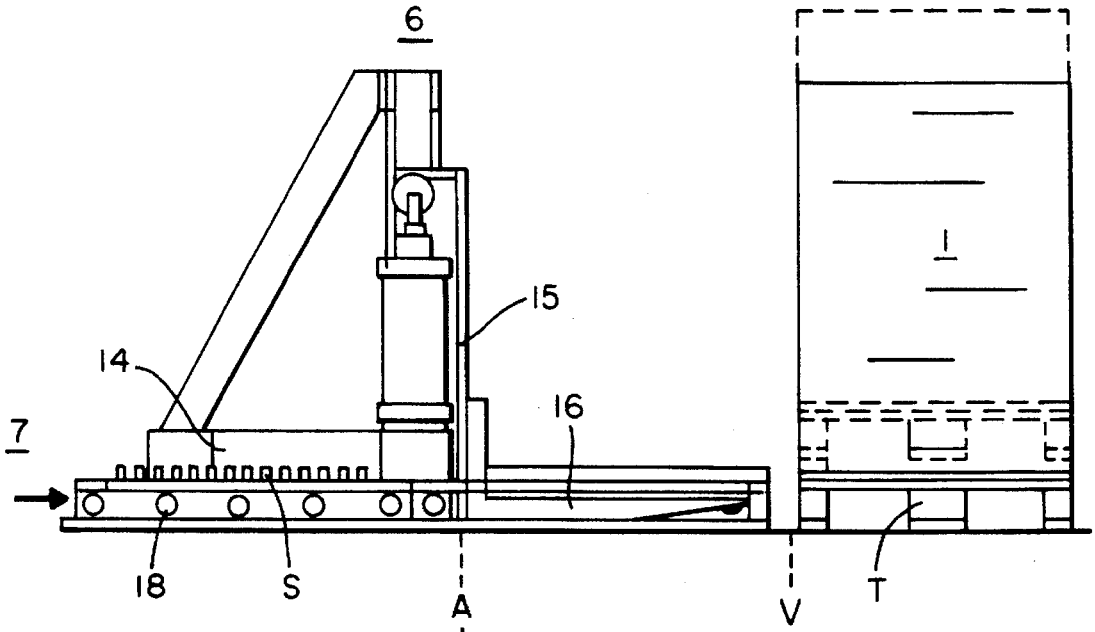
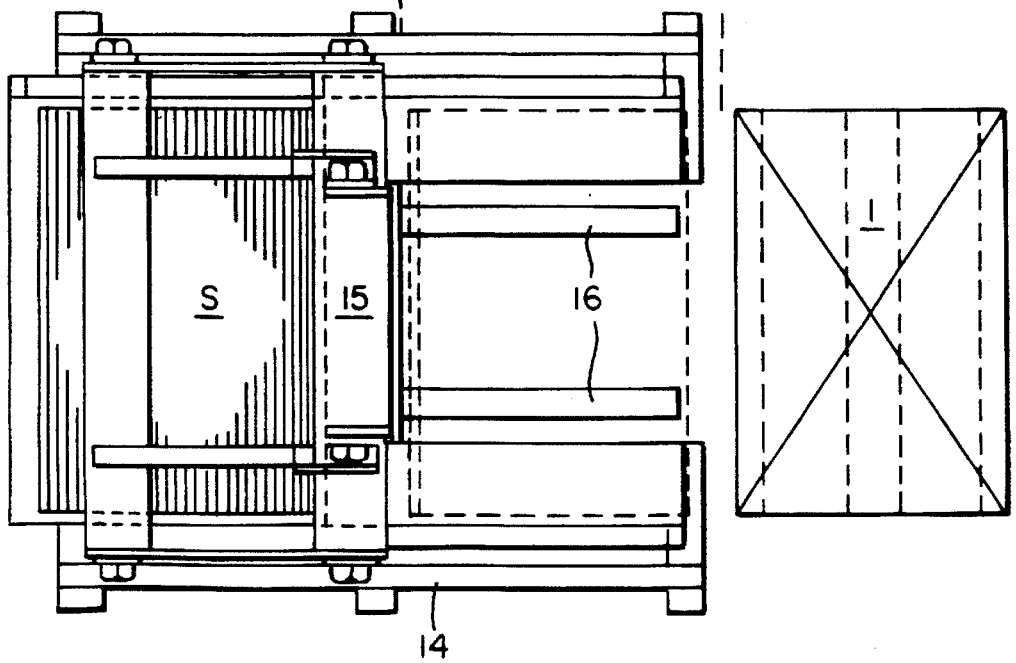
FIG. 3

METHOD FOR PREPARING A SHEET STACK FOR PROCESSING IN A SHEET-PROCESSING MACHINE

FIELD OF THE INVENTION

The invention relates generally to sheet-processing machines, and more particularly to a method and apparatus for preparing a sheet stack for processing in a sheet-processing machine.

BACKGROUND OF THE INVENTION

Sheet-processing machines often employ automation for feeding sheets and printing matter (i.e. paper) to the sheet-processing machine, and for transporting the printing matter away. Extensive conveying/feeding systems are already known for this purpose. A particular problem arises in regard to the processing of incoming Sheet stacks which are to be processed by the machine. The sheet stacks are usually packaged and deposited on a so-called EURO-pallet as a transportation pallet. However, the EURO-pallet is usually not suitable for processing in an automated sheet-processing machine due, for example, to its dimensions being incompatible with the conveying/feeding systems of the sheet-processing machine. Moreover, the sheet stack may be in a skewed or misaligned state which does not permit direct further processing. Up until now, a number of manual operations have thus been necessary in order to prepare the sheet stack for processing in the machine. The EURO-pallets which are not suitable for the conveying/feeding systems have to be exchanged for so-called system pallets, which have the necessary dimensions and characteristics for processing by the machine. Following, or along with, exchange of the transportation pallet and system pallet, it has been necessary to supply the sheet stack with air and align it. This need for manual manipulation of the sheet stack and pallet adds undue labor, time and cost to an otherwise automated process.

SUMMARY OF THE INVENTION

Accordingly, it is the primary object of the invention to achieve automated preparation of the sheet stack for a high-performance sheet-processing machine and to avoid strenuous physical work during the exchange of the pallets.

In accordance with this and other objects of the invention; there is provided a method wherein a sheet stack and transportation pallet are deposited on a system pallet to form a compound stack, and wherein the compound stack is then manipulated so that the transportation pallet is freed and removed such that the resulting sheet stack and system pallet are then ready for further processing. An apparatus is also provided in accordance with the objects of the invention. The apparatus includes a lifting device for raising the sheet stack and transportation pallet, a pallet feeder for conveying an empty system pallet beneath the raised transportation pallet and sheet stack to form a compound stack, and a stack manipulator which grips the compound stack and moves it to a release position where a handling apparatus removes and transports the freed transportation pallet away from the compound stack. A conveying device conveys the system pallet and sheet stack to the sheet-processing machine.

It has proved particularly advantageous in the method and apparatus of the invention that the changeover of the sheet stack from the transportation pallet onto the system pallet, which is necessary in the sheet-processing machine, takes place in an automated processing line. Moreover, the preparation of the sheet stack to meet with the machine requirements can be achieved without manual intervention. Additional features and advantages will be apparent from the following specification and claims.

BRIEF DESCRIPTION OF THE DRAWINGS

The invention is described in more detail with reference to certain preferred embodiments, as shown in the drawings, in which:

FIGS. 2 and 3 show a side and top view, respectively, of a pallet-changing means according to preferred embodiment of the invention.

DETAILED DESCRIPTION OF THE PREFERRED EMBODIMENTS

While the invention will be described with reference to the preferred embodiments, it will be obvious to those of ordinary skill in the art that variations of these preferred embodiments may be used and it is intended that the invention may be practiced otherwise than as specifically described herein. Accordingly this invention includes all modifications and equivalents encompassed within the spirit and scope of the invention as defined by the appended claims.

The method and associated apparatus according to the invention provide for exchange of a transportation pallet (e.g. a EURO-pallet) for a system pallet beneath a sheet stack to be processed. Generally, this occurs by means of the transportation pallet and sheet stack being deposited on a system pallet to form what will be referred to herein as a compound stack (system pallet, transportation pallet and sheet stack). Following this, the compound stack is acted on by a stack manipulator to move the stack to a release position, wherein the transportation pallet is freed from the compound stack and is removed therefrom. Once the transportation pallet is removed, the resulting stack of the system pallet and sheet stack can then be properly oriented and conveyed to the sheet-processing portion of the machine.

Figure 1:
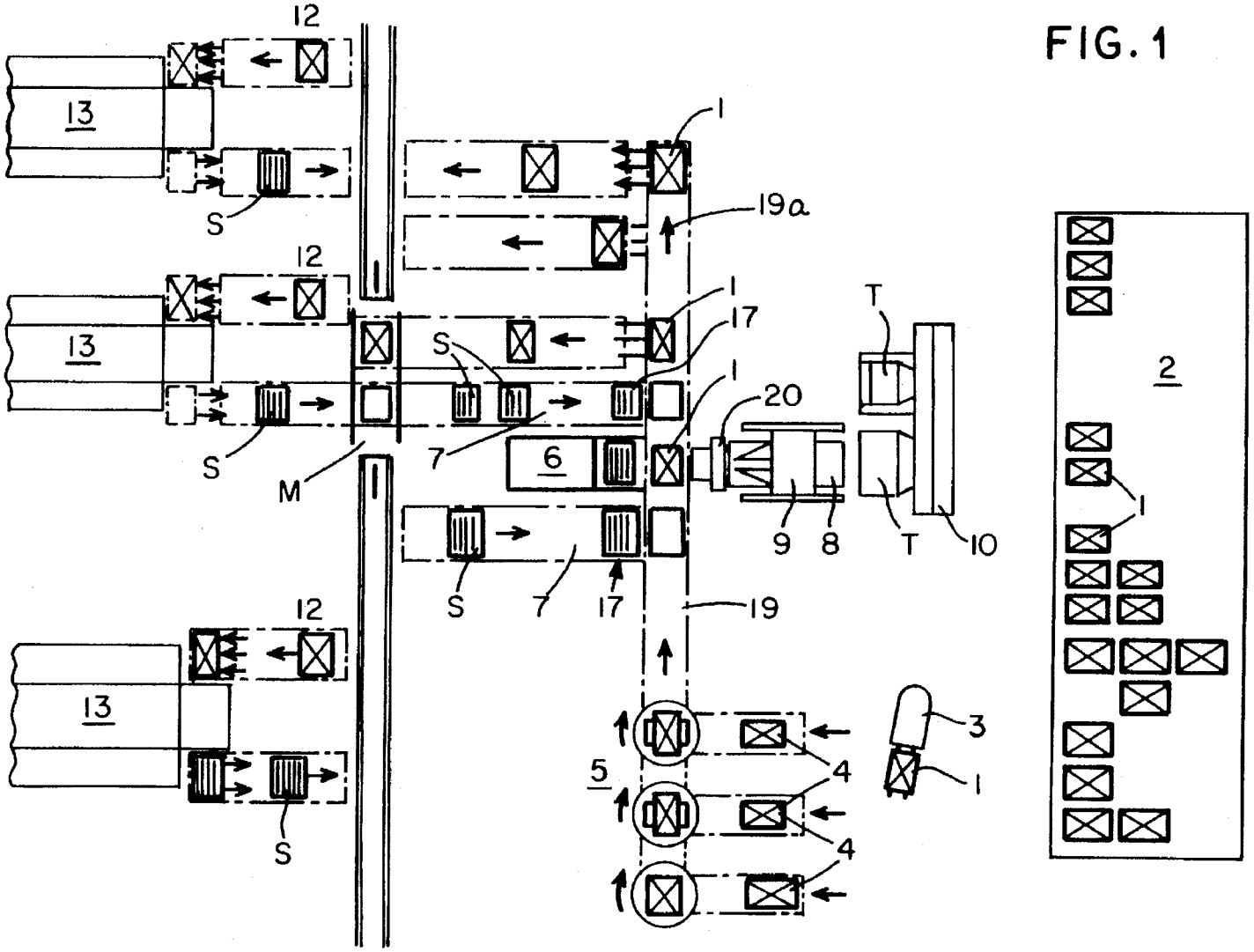
FIG. 1 shows a system according to the invention.

To provide this improved process according to the invention, the system according to the invention comprises a plurality of components and manipulation steps. FIG. 1 shows that a new sheet stack 1 and its associated transportation pallet are deposited at an unloading station and placed in a paper store 2. For processing, the new sheet stack 1 and its associated transportation pallets are removed from the paper store 2, for example by an operatorless industrial truck 3, and transported to a preparation station 4 where it is unpacked. However, unpacking can also take place in the paper store 2 for acclimatization purposes. Following unpacking, the new sheet stack 1 and its associated transportation pallet are placed in a preparation line 5. In the preparation line 5, the new sheet stack 1 is transferred on its still-present transportation pallet T (e.g. EURO-pallet), via a conveying device 19 in a conveying direction 19*a*.

To provide for depositing of the sheet stack and transportation pallet onto a system pallet, a pallet inserter 6 is provided. Associated with the pallet inserter 6 is a feed device 7 in which system pallets S can be moved, from the rear, into the operating region of the pallet inserter 6. The feed device 7 interacts with a pallet store 17 for system pallets S.

A more detailed embodiment of a preferred pallet inserter 6 is illustrated in FIGS. 2 and 3. It includes a framework 14, on the front side of which is disposed a lifting device in the form of a forklift apparatus 15. The framework 14 can be displaced in the longitudinal direction. Consequently, lift forks 16 of the forklift apparatus 15 can be moved into the transportation pallet T of an advanced sheet stack 1. Disposed on the rear side of the pallet inserter 6 is a pallet feeder in the form of a roller conveyor 18 on which the system pallets S are placed. The system pallets S are removed from the pallet store 17 and fed to the pallet inserter 6 by feed device 17.

In the initial position A (shown by a dashed line in FIGS. 2 and 3), the pallet inserter 6 is in a central position, a system pallet S being disposed on the roller conveyor 18. When a sheet stack 1 is delivered on the conveying device 19, the pallet inserter 6 moves forward (to the right in FIG. 2) and the forklift apparatus 15 receives the sheet stack 1 on the transportation pallet T. At the same time, the system pallet S is pushed forward into position V (see FIGS. 2 and 3). This can take place in conjunction with the forward movement of the pallet inserter 6 or via a separate transportation device. In position V, the system pallet S is aligned with conventional means, such as stops. The forklift apparatus 15 raises the sheet stack 1 and moves back into the initial position A, whereby the sheet stack 1 is moved over the system pallet S, which is now located in a forward position. The transportation pallet T and sheet stack 1 are then deposited on the system pallet S to form the compound stack. The pallet inserter 6 then moves the forklift apparatus 15 back until the lift forks 16 are brought out of the transportation pallet T.The lift forks 16 can then be lowered and moved into the system pallet S. The compound stack is raised and is deposited on the conveying device 19 upstream of the pallet inserter 6.

Figure 4:
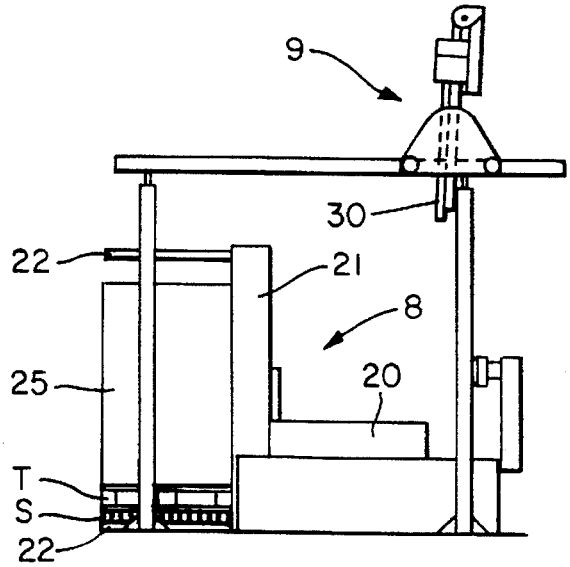
FIGS. 4 through 6 show somewhat simplified elevational views of a stack manipulator in various phases of operation according to the invention.
Figure 5:
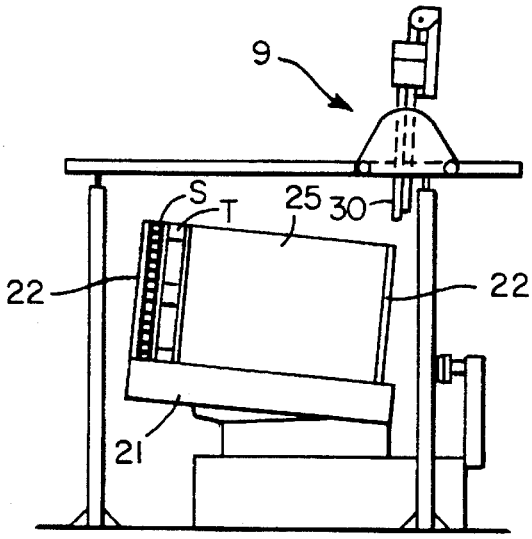
Figure 6:
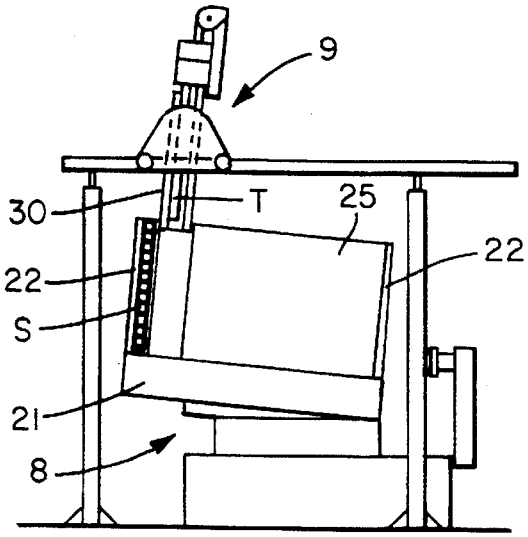

To further manipulate the compound stack, and according to the present embodiment, there is provided opposite (e.g. on the opposite side of the conveying device 19) the pallet inserter 6 a stack manipulator, which may be in the form of a commercially available, automated stack-turning device 8. The stack-turning device 8, shown in greater detail in FIGS. 4–6, is fully disclosed in terms of its structural and functional details in U.S. patent application Ser. No. 08/446,284, filed concurrently herewith, the teachings of which are expressly incorporated herein by reference. Even so, a brief description of the device is included herein.

Referring to FIG. 4, the stack turning device 8 includes an undercarriage and a pivotable retaining device 20 arranged thereon. The retaining device 20 comprises a crossbar 21 and, located opposite one another thereon in the direction of the crossbar, longitudinally are displaceable gripping areas 22. The stack-turning device 8 is capable, with the aid of its undercarriage, of moving up to the compound stack 25, to receive the entire assembly, with the lower fork-like gripping arm 22 of the stack-turning device 8 being inserted into the system pallet S. After the gripping arms 22 are actuated to grip the stack 25, the stack-turning device 8 tilts the sheet stack 1 together with the pallets T, S into a release position as shown in FIG. 5. The release position may be slightly beyond horizontal (e.g. 95°) as in FIG. 5. Alternatively, the stack turning device could completely invert the compound stack 25 (by a compound movement about horizontal and vertical axis) to place pallets T and S above the paper stack. In either case, the release position is a position wherein release of the gripping arms 22 from the compound stack will free pallet T so that it may be removed from the compound stack without disrupting the sheet stack 1. Subsequent actuation of the gripping arms 22 causes them to grip a new stack comprising only system pallet S and sheet stack 1.

For the purpose of removing the transportation pallet T, when the compound stack is in the release position, there is provided a handling unit 9, which is associated with the stack-turning device 8. The handling unit is shown in operation in FIG. 6. With the compound stack in the release position, grippers 30 may be actuated to grip pallet T and remove it from the stack. When the transportation pallet T is separated from the stack 25, it is then transported away into a pallet store by the handling unit 9. Subsequently, the sheet stack 1 is clamped on the stack-turning device 8 again, and is thus deposited on the system pallet S.

In order to improve the stack quality, the sheet stack 1 may be vibrated, provided with air and aligned as an intermediate step. The stack-turning device 8 is equipped correspondingly. After depositing of the sheet stack 1 which has been prepared in this manner and deposited onto a system pallet S, the sheet stack 1 can be conveyed by conveying device 19 (FIG. 1) and subsequently moved by a transportation system 11 to the standby position 12 for the sheet-processing machines 13 for further processing. From there, the sheet stack 1 is either fed directly or advanced with the aid of an auxiliary transportation means. The entire apparatus may be set up in a line around the conveying device 19, such that it is aligned with respect to the sheet-processing machines 13. At the same time, provision may be made for pallet stores 17 for the system pallets S and pallet stores 10 for the transportation pallets T that are accumulated by the process and apparatus of the invention. Manual handling of the individual pallets and movement of the same back and forth within the processing operation are no longer necessary.

Several modifications to both the process and apparatus described will occur to one skilled in the art, yet still remain within the scope of the invention. For example, the process described can be varied in that the stack-manipulator is used for depositing the sheet stack 1, together with its transportation pallet T, onto the system pallet S directly. The feed device 7 for the system pallet S is then assigned, in a corresponding manner, to the stack-manipulator. However, this increases the period during which the stack-manipulator is occupied. It is thus a question of cost effectiveness as to whether the system can manage with or without a separate pallet inserter.

What is claimed is:

1. A method for automated preparation of a sheet stack for processing in a sheet-processing machine, the sheet stack being initially received and transported on a transportation pallet, the method comprising the steps of:

(a) depositing the transportation pallet and sheet stack on a system pallet to form a compound stack;

(b) gripping the compound stack and moving it to a release position;

(c) releasing the grip on the compound stack to free the transportation pallet for movement relative to the compound stack;

(d) removing the transportation pallet from the compound stack;

(e) gripping the sheet stack and system pallet;

(f) moving the sheet stack and system pallet to a conveying position; and (g) conveying the sheet stack and system pallet to the sheet-processing machine.

2. The method according to claim 1, wherein the depositing of the transportation pallet and sheet stack on the system pallet is performed by a pallet inserter, and including the step of moving the compound stack to a stack manipulator, and further including the steps of freeing and removing the transportation pallet from the compound stack in the stack manipulator.

3. The method according to claim 1 wherein the steps of depositing of the transportation pallet and sheet stack on the system pallet, moving the compound stack to the release position; and freeing and removing of the transportation pallet are performed by a stack manipulator.

4. The method according to claim 1, wherein the steps of gripping and removing the freed transportation pallet from the compound stack are performed by a handling unit.

5. An apparatus for preparation of a sheet stack for automated processing in a sheet-processing machine by exchange of a transportation pallet for a system pallet, the apparatus comprising, in combination:

a lifting device for gripping and raising the transportation pallet and sheet stack;

a pallet feeder for conveying system pallets to a position beneath the raised transportation pallet and sheet stack to form a compound stack;

a stack manipulator for gripping the compound stack, the stack manipulator being adapted to move the compound stack to a release position; and to release the compound stack to free the transportation pallet, the stack manipulator including a handling apparatus for removing and transporting the freed transportation pallet from the compound stack; and a conveying device for conveying the system pallet and sheet stack from the stack manipulator to the sheet-processing machine.

6. The apparatus according to claim 5, wherein the stack manipulator includes the lifting device and the pallet feeder.

7. The apparatus according to claim 5, wherein the lifting device is part of a pallet inserter that includes a forklift apparatus for raising and lowering the sheet stack and transportation pallet, and said pallet inserter further including the pallet feeder.

8. The apparatus according to claim 7, including a pallet store and a feed device, and wherein the pallet store and the feed device are coupled to the pallet inserter such that empty pallets are removed from the pallet store and conveyed by the feed device to the pallet feeder.

9. The apparatus of claim 8, wherein the pallet feeder is a roller conveyor disposed opposite the forklift apparatus in the pallet inserter.

10. The apparatus according to claim 5, wherein the stack manipulator includes a retaining device for gripping the compound stack, the retaining device being pivotable about a horizontal axis parallel to the conveying direction, and rotatable about a vertical axis.

11. The apparatus according to claim 5, wherein the handling apparatus deposits the removed transportation pallet in a pallet store.

* * * * *